US005646720A

United States Patent [19]

Song

[11] Patent Number: 5,646,720

[45] Date of Patent: Jul. 8, 1997

[54] LASER PRINTER HAVING A PAPER FEEDING AND TRANSFER DEVICE

[75] Inventor: Hyon Myong Song, Seoul, Rep. of Korea

[73] Assignee: Goldstar Co., Ltd., Seoul, Rep. of Korea

[21] Appl. No.: 501,151

[22] Filed: Jul. 11, 1995

Related U.S. Application Data

[63] Continuation of Ser. No. 263,235, Jun. 21, 1994, abandoned.

[30] Foreign Application Priority Data

Jun. 21, 1993 [KR] Rep. of Korea ..... 10965/1993

[51] Int. Cl.[6] ..... G03G 21/00; B65H 3/44

[52] U.S. Cl. ..... 399/361; 271/9.01; 271/9.13

[58] Field of Search ..... 355/308, 309, 355/311; 346/108, 134, 160; 271/9.01, 9.09, 9.13, 184, 185, 225

[56] References Cited

U.S. PATENT DOCUMENTS

| | | | |
|---|---|---|---|
| 5,038,228 | 8/1991 | Takada | 355/308 X |
| 5,052,670 | 10/1991 | Makiura et al. | 271/9 |
| 5,140,369 | 8/1992 | Haneda et al. | 355/309 X |
| 5,150,166 | 9/1992 | Matsuura et al. | 355/308 |

FOREIGN PATENT DOCUMENTS

| | | | |
|---|---|---|---|
| 1-53944 | 3/1989 | Japan | 271/9 |
| 5-32350 | 2/1993 | Japan | 271/9 |
| 5-201561 | 8/1993 | Japan | 271/9 |

*Primary Examiner*—Fred L. Braun

*Attorney, Agent, or Firm*—Fish & Richardson, P.C.

[57] ABSTRACT

A laser printer includes a body, a cassette located in a lower part of the body for loading paper, a first paper feed roller for drawing paper from the cassette, and a first transfer path along which paper drawn from the cassette is guidingly transported. An open/close door is located at a front side of the body, wherein the door, when opened, exposes the first transfer path. A first guide part is located on an inside surface of the door and forms a portion of the first transfer path and guides the paper. A piece sheet feed opening is located at the front side of the body and leading to the first transfer path. The laser printer also includes a second transfer path adjacent to the first transfer path, a drum located below the second transfer path, and a second paper feed roller for transferring paper from the piece sheet feed opening and paper drawn from the cassette. The second paper feed roller is located inside the body opposite the piece sheet feed opening and between the first and second transfer paths. A print-through part for printing toner on the paper is located above the second transfer path. A settler for settling the toner printed on the paper is located next to the print-through part in an upper part of the body, and a discharge paper tray is located in the upper part of the body and opened to the settler.

2 Claims, 2 Drawing Sheets

LASER PRINTER HAVING A PAPER FEEDING AND TRANSFER DEVICE

This application is a continuation of U.S. application Ser. No. 08/263,235, filed Jun. 21, 1994, now abandoned.

FIELD OF THE INVENTION

This invention relates to a paper feeding device for a laser beam printer, more particularly to a device for loading printed regular or non-regular size paper on top of the printer.

DESCRIPTION OF THE PRIOR ART

Shown in FIG. 1 is a cut-away view of one kind of conventional device which includes a cassettes for loading regular size paper 2 at the bottom of body 1, feeding rollers 12 for drawings paper 2 from the cassette 3, a drum 4 and a print-through part 5 carrying out required printing on the regular size paper 2 fed by the rollers 12, a settler 10 for settling the printing on the regular size paper 2, discharge rollers 8 for discharging the printed regular size paper 2, and a first tray on which the regular size paper 2 passed through the discharge roller 8 is stacked, with the printed surface faced down.

And the conventional device also includes a piece sheet feed opening 7 at the front of the body 1 on a straight line with the drum 4 and the print-through part 5 for feeding non-regular regular size paper or a thick envelope therein, and a second tray 11 on which the non-regular size paper is stacked after completion of printing, with the printed surface faced up.

With the foregoing construction, on pressing a start button, the regular size paper 2 in the cassette 3 is transferred to the drum 4 and the print-through part 5 by the feed roller 12.

Charged toner on the surface of the drum 4 is printed through on the surface of the regular size paper 2 as the transferred regular size paper 2 is passed between the drum 4 and the print-through part 5. The regular size paper 2 the toner has been printed-through thereon is, passed through a settling process in the settler 10, discharged by the discharge roller 8 into the first tray 9, with the printed surface faced down.

Meantime, to print in pieces, a sheet of non-regular size paper or a thick envelope 6 is pushed into the piece sheet feed opening 7. The pushed fed non-regular size paper 6 is discharged into the second tray 11 in rear of the body 1 after completion of copying by taking the same process as the regular size paper 2.

The conventional device operated as the foregoing has following problems.

First, in the conventional device, when a sheet of paper or an envelope 6 is pushed into the piece sheet feed opening 7 for piece sheet copy, the non-regular size paper 6 after a copying has been completed is discharge into the second tray 11 in rear of the body 1. Therefore, picking up of the paper a copying having been completed is not convenient and the copy machine occupies wider space.

Second, the heat dissipation of the conventional device is slow because the settler 10 is located at the lower part of the body 1.

Third, removal operation of the Jammed paper is cumbersome because the drum 4 has to be lifted for removal of paper whenever a paper jam occurs.

SUMMARY OF THE INVENTION

This invention relates to a paper feeding device for a laser beam printer, more particularly to a device for loading printed regular and non-regular size paper on top of the printer.

These and other objects and features of this invention can be achieved by providing a laser beam printer including a body, a cassette positioned at the bottom of the body loaded with paper for copy, a first transfer path for guiding the paper drawn from the body, a piece sheet feed opening formed above the door leading to the first transfer path, a second transfer path formed at 90 deg. to the first transfer path, a drum formed under the second transfer path, a developing unit for suppling toner to the drum a print-through part positioned over the drum for printing toner through the paper transferred through the second transfer path, a settler positioned on a straight line with the print-through part for settling the printed-through toner, and a discharge paper tray in the aft-upper part of the body opened to the settler.

DETAILED DESCRIPTION OF THE EMBODIMENT

One embodiment of this invention is to be explained in detail hereinafter, referring to the attached drawing FIG. 2.

And, to avoid confusion of meaning, same reference number is to be used for parts having the same structure and the same function in explaining embodiments of this invention.

Figure 1:
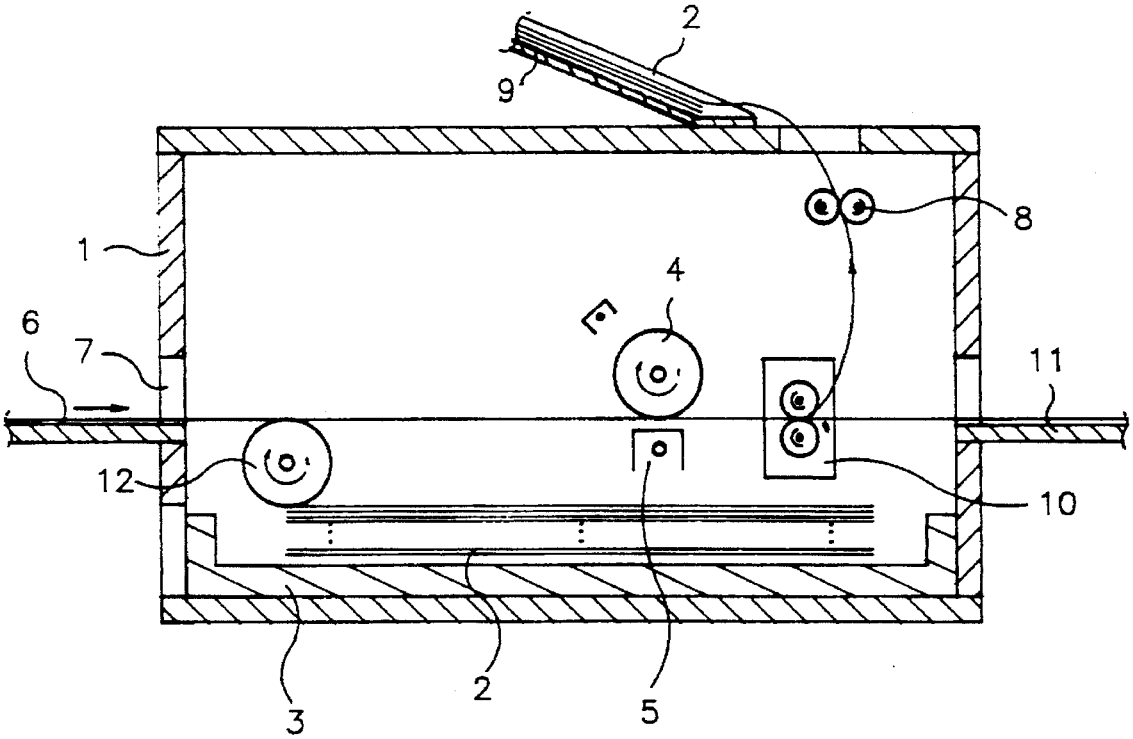
FIG. 1 PRIOR ART
FIG. 1 is a conventional paper feeding device for a laser printer.
Figure 2:
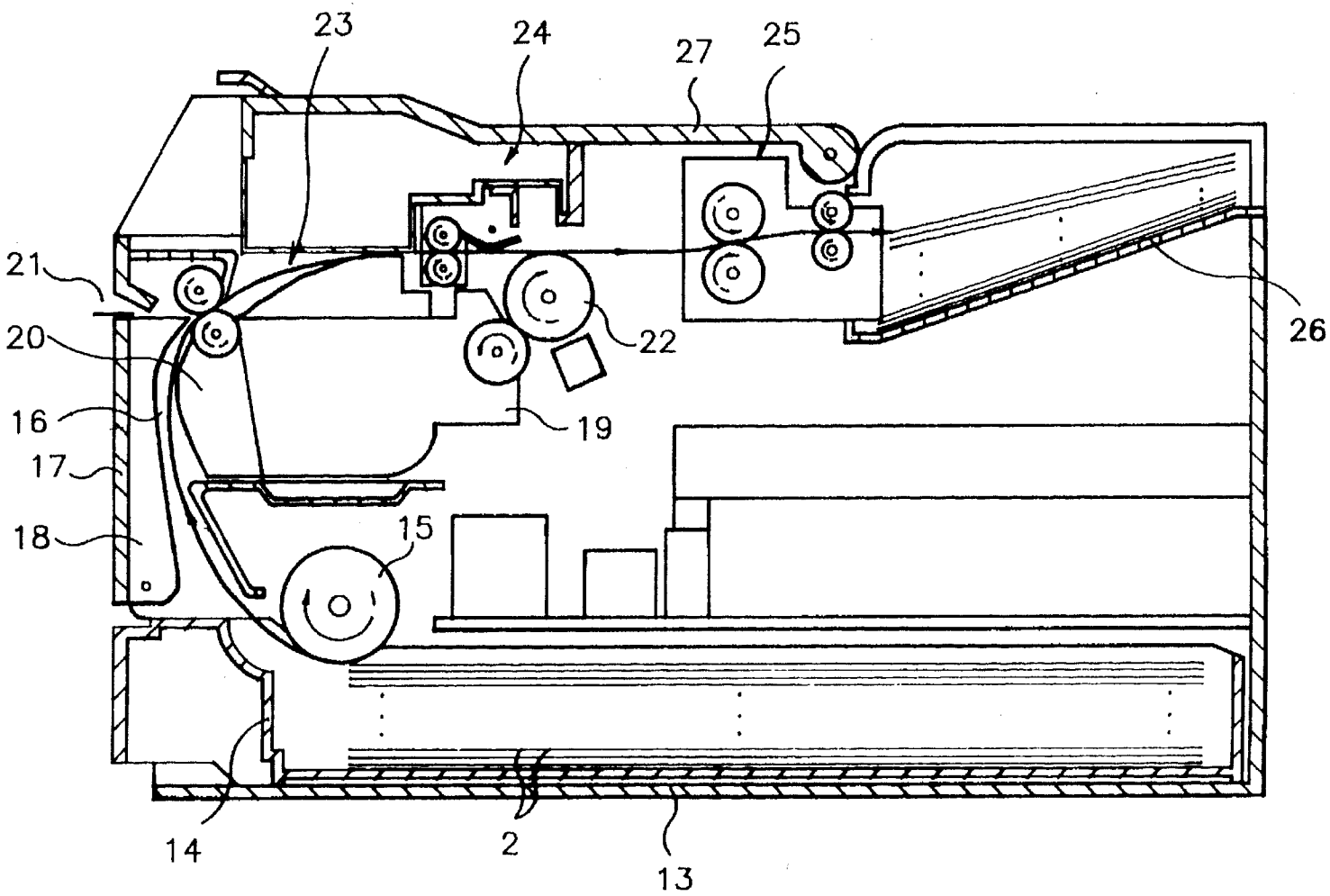
FIG. 2 is a paper feeding device for a laser printer in accordance with this invention.

As shown in FIG. 2, the laser printer of this invention includes a body 13, a cassette 14 in the lower part of the body 13 for loading paper for copying, a first transfer path 16 guiding transfer of the paper drawn from the cassette 14, an open/close door 17 at the front of the body 13 forming a part of the first transfer path 16, a developing unit(19) which can be changed after opening the door(17) and formed at the front side of the drum(22) a piece sheet feed opening 21 formed over the door 17 leading to the first transfer path 16, a second transfer path 23 formed at 90 deg. to the first transfer path 16, a drum under the second transfer path 23, a print-through part 24 over the drum 22 for printing toner through the paper 2 transferred through the second transfer path 23, a settler 25 on a straight line with the print-through part 24 for settling the toner printed through the paper, and a discharge paper tray 26 in aft-upper part of the body 13 opened to the settler 25.

And the first transfer path 16 has first guide ribs 18 on inside surface of the door 17, and second guide ribs 20 formed opposite to the first guide ribs 18.

Detailed operation and the consequential effect of this invention having the foregoing construction is to be described hereinafter.

First, a cassette 14 loaded with stack of regular size paper 2 is loaded into lower part of the body 13. Upon pressing a start button after completion of loading of the cassette 14, the paper feed roller 15 transfers a sheet of regular size paper 2 drawn from the top of the stack of paper to the first transfer path 16.

According to this, the regular size paper 2 is passed through the first transfer path 16 guided by the first and the second guide ribs 18 and 20, changes direction of movement at 90 deg., and enters into the second transfer path 23.

If the regular size paper should jam in the first transfer path 16 during above transfer process, the door 17 at the front of the body 13 is opened exposing the first transfer path 16, thereby the paper jammed in the first transfer path 16 can be removed.

The regular size paper 2 entered into the second transfer path 23 is, passed through the top of the drum 22 and under the print-through part 24, and printed with the toner.

The regular size paper 2, passed through the drum 22 and the print-through part 24, has the toner settled in the settler 25, transferred to the discharge paper tray 26 positioned in aft-upper part of the body 13, and settled therein with the printed surface faced down.

On the other hand, in case a copying on a sheet of non-regular regular size paper is desired, the sheet of non-regular size paper has to be pushed into the piece sheet feed opening 21 formed over the door 17. The non-regular size paper pushed into the piece sheet feed opening 21 is transferred through upper part of the first transfer path 16, and the second transfer path 23.

If the non-regular size paper should jam while the paper is transferred through upper part of the first transfer path 16 and the second transfer path 23, a cover 27 on top of the body 13 can be opened, exposing the second transfer path 23, thereby the jammed non-regular size paper can be removed from the exposed second transfer path 23.

The non-regular size paper entered into the second transfer path 16 is, passed through upper part of the drum 22 and under the print-through part 24, printed with the toner. The non-regular size paper passed through the drum 22 and the print-through part 24 has the toner settled in the settler 25, and loaded into the discharge paper tray 26 opened to the settler 25 positioned in aft-upper part of the body with the printed surface faced down.

This invention performing the foregoing operation has following advantages.

First, in accordance with this invention, if a sheet of non-regular size paper or a sheet of thick envelope is pushed into the piece sheet feed opening 21 in order to make a copy on the sheet, the non-regular size paper will be discharged into the discharge paper tray 26 in aft-upper part of the body 13 after completion of copying. Therefore it is easy to pick-up the copied paper and the copy machine occupies less space.

Second, this device is faster in heat dissipation because the settler 25 is positioned in the upper part of the body 13.

Third, this device does not require a drum to be lifted from its position at occurrence of a jam and it is easy to remove jammed paper because the front and the top of the body 13 can be opened.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. A laser printer comprising:

a body;

a cassette located in a lower part of the body for loading paper;

a first paper feed roller for drawing paper from the cassette;

a first transfer path along which paper drawn from the cassette is guidingly transported;

an open/close door located at a front side of the body, wherein the door, when opened, exposes the first transfer path;

a first guide part located on an inside surface of the door, wherein the first guide part forms a portion of the first transfer path and guides the paper;

a piece sheet feed opening located at the front side of the body and leading to the first transfer path;

a second transfer path adjacent to the first transfer path;

a drum located below the second transfer path;

a second paper feed roller for transferring paper from the piece sheet feed opening and paper drawn from the cassette, wherein the second paper feed roller is located inside the body opposite the piece sheet feed opening and between the first and second transfer paths;

a print-through part for printing toner on the paper, wherein the print-through part is located above the second transfer path;

a settler for settling the toner printed on the paper, wherein the settler is located next to the print-through part in an upper part of the body; and a discharge paper tray located in the upper part of the body and opened to the settler.

2. The laser printer claimed in claim 1, wherein the first guide part includes first guide ribs on the inside surface of the door and wherein the laser printer further comprises a second guide part with second guide ribs opposite to the first guide ribs.

* * * * *